US008926044B2

(12) United States Patent
Iesaki

(10) Patent No.: US 8,926,044 B2
(45) Date of Patent: Jan. 6, 2015

(54) IMAGE FORMING APPARATUS

(71) Applicant: Kenichi Iesaki, Ichinomiya (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/848,802

(22) Filed: Mar. 22, 2013

(65) Prior Publication Data

US 2013/0257953 A1 Oct. 3, 2013

(30) Foreign Application Priority Data

Mar. 30, 2012 (JP) ..... 2012-081042

(51) Int. Cl.
*B41J 29/38* (2006.01)
*B41J 2/045* (2006.01)
*B41J 19/20* (2006.01)

(52) U.S. Cl.
CPC ..... *B41J 2/04501* (2013.01); *B41J 19/202* (2013.01)
USPC ..... 347/14

(58) Field of Classification Search
CPC ..... B41J 2/4501; B41J 2/04503; B41J 19/18; B41J 29/38
USPC ..... 347/14
See application file for complete search history.

(56) References Cited

U.S. PATENT DOCUMENTS

| | | | | |
|---|---|---|---|---|
| 7,438,380 | B2 * | 10/2008 | Ishikawa | 347/19 |
| 8,287,088 | B2 | 10/2012 | Iesaki | |
| 2010/0123751 | A1 | 5/2010 | Iesaki | |

FOREIGN PATENT DOCUMENTS

| | | | | |
|---|---|---|---|---|
| JP | 09-058081 | A | 3/1997 | |
| JP | 2005-238840 | * | 9/2005 | B41J 19/18 |
| JP | 2005-335259 | A | 12/2005 | |
| JP | 2006-205610 | A | 8/2006 | |
| JP | 2010-120252 | A | 6/2010 | |
| JP | 2011-109890 | A | 6/2011 | |

* cited by examiner

*Primary Examiner* — Alessandro Amari
*Assistant Examiner* — Michael Konczal
(74) *Attorney, Agent, or Firm* — Banner & Witcoff, Ltd.

(57) ABSTRACT

An image forming apparatus includes a recording head which jets ink droplets, a head transporting mechanism which transports the recording head, and a control unit which controls the head transporting mechanism to reciprocate the recording head along a transporting path and controls the recording head to form an image on a sheet by jetting the ink droplets when the recording head passes over an image formation area within the transporting path. When the control unit controls the transporting mechanism to transport the recording head toward a turn-around point in the transporting path, the control unit decelerates the recording head in accordance with a first acceleration profile and a second acceleration profile which has a peak of deceleration higher than that of the first acceleration profile.

11 Claims, 10 Drawing Sheets

IMAGE FORMING APPARATUS

CROSS REFERENCE TO RELATED APPLICATION

The present application claims priority from Japanese Patent Application No. 2012-081042 filed on Mar. 30, 2012, the disclosure of which is incorporated herein by reference in its entirety.

BACKGROUND OF THE INVENTION

1. Field of the Invention

The present invention relates to an image forming apparatus which forms an image on a sheet.

2. Description of the Related Art

An image forming apparatus which forms an image on a sheet while making a recording head reciprocate has hitherto been known. For instance, an ink jet printer, which forms an image on a sheet by jetting ink droplets from a recording head while transporting the recording head in a main scanning direction up to a turn-around point after transporting the sheet by a predetermined amount in a secondary scanning direction, has been known.

Moreover, as a technology related to an image forming apparatus of such type, a technology, in which an upper-limit value is provided for an output of a PID controller (proportional integral derivative controller) for suppressing jetting of an ink from becoming unstable due to an excessive acceleration of a carriage carrying a recording head, has been known. Apart from the abovementioned technology, an image forming apparatus, in which a transporting path of a recording head is made short for miniaturizing the apparatus, and also, an arrangement is made such that image formation is carried out even while the recoding head is accelerated and decelerated, has been known.

Incidentally, at the time of forming an image on a sheet, if the acceleration or deceleration is too great, jetting of an ink becomes unstable, and for this reason, sometimes it is not possible to accelerate or decelerate a carriage with the maximum capacity of a motor. Moreover, in a case of deceleration at the time of forming an image, since it is not possible to decelerate the carriage by setting the deceleration to the maximum capacity of the motor, sometimes, it takes time to decelerate and stop the carriage. Therefore, according to the conventional technology, it is not possible to shorten the time required for turn-around transporting of the carriage carrying a recording head, and sometimes it becomes difficult to improve a throughput of processing related to the image formation on a sheet.

SUMMARY OF THE INVENTION

The present invention has been made in view of the abovementioned issues, and an object of the present invention is to carry out transporting of the recording head at a high velocity while maintaining a favorable quality of an image which is formed on the sheet.

An image forming apparatus according to the present invention which has been made to achieve the abovementioned object, includes, a recording head which jets ink droplets, a head transporting mechanism which transports the recording head, and a control unit. The control unit controls the head transporting mechanism to make the recording head reciprocate along a transporting path, and also controls the recording head to make jet the ink droplets to form an image on a sheet which is facing the recording head when the recording head passes over an image formation area which is an area in the transporting path to carry out an operation of image formation.

Particularly, the control unit, at the time of transporting the recording head toward a turn-around point in the transporting path, decelerates the recording head from a deceleration-staring point at an upstream side of the turn-around point, and in a case, in which a trailing end of the image formation area is positioned between the deceleration-starting point and the turn-around point, the control unit controls the head transporting mechanism such that, a peak of deceleration in an interval from the trailing end of the image formation area up to the turn-around point is higher than a peak of deceleration in an interval from the deceleration starting point up to the trailing end of the image formation area.

It is possible to make an arrangement such that, the control unit, for instance, in the course of reciprocating movement of the recording head, at the time of transporting the recording head toward the turn-around point by controlling the head transporting mechanism, decelerates the recording head according to a first acceleration profile (an acceleration trajectory), from a deceleration-starting point which has been determined in advance, up to a trailing end of the image formation area, and decelerates the recording head according to a second acceleration profile (an acceleration trajectory) with a peak of deceleration higher than a peak of deceleration of the first acceleration profile, from the trailing end of the image formation area up to the turn-around point.

In a case, in which the deceleration-starting point is at an upstream side in the transporting direction of the recording head than the trailing end of the image formation area, it is necessary to make the recording head jet the ink droplets while decelerating the recording head. However, when the recording head is decelerated excessively during the period in which the jetting of ink droplets is carried out, the recording head may get tilted for example, due to the deceleration, and a quality of image formed on the sheet is degraded. Consequently, when the image quality is taken into consideration, during the period when the jetting of ink droplets is carried out, it is not preferable to let the deceleration of the recording head to be excessively large.

However, when the deceleration of the recording head is low, it takes time to decelerate and stop the recording head. Whereas, even when the deceleration is made large during the time when the jetting of ink droplets is not to be carried out, there is no effect or a small effect on the image quality.

Therefore, in the present invention, at the time of transporting the recording head from the trailing end of the image formation area up to the turn-around point, the recording head is decelerated with a large deceleration by controlling the head transporting mechanism such that, a peak of the deceleration is higher than a peak of the deceleration from the deceleration-starting point up to the trailing end of the image formation area.

In such manner, according to the present invention, depending upon whether or not it is a deceleration which also involves the jetting of ink droplets, a different deceleration is to be used. Therefore, it is possible to transport the recording head at a high velocity by using effectively the capacity of a motor, while maintaining a favorable quality of an image formed on the sheet.

DETAILED DESCRIPTION OF THE PREFERRED EMBODIMENTS

Figure 1:
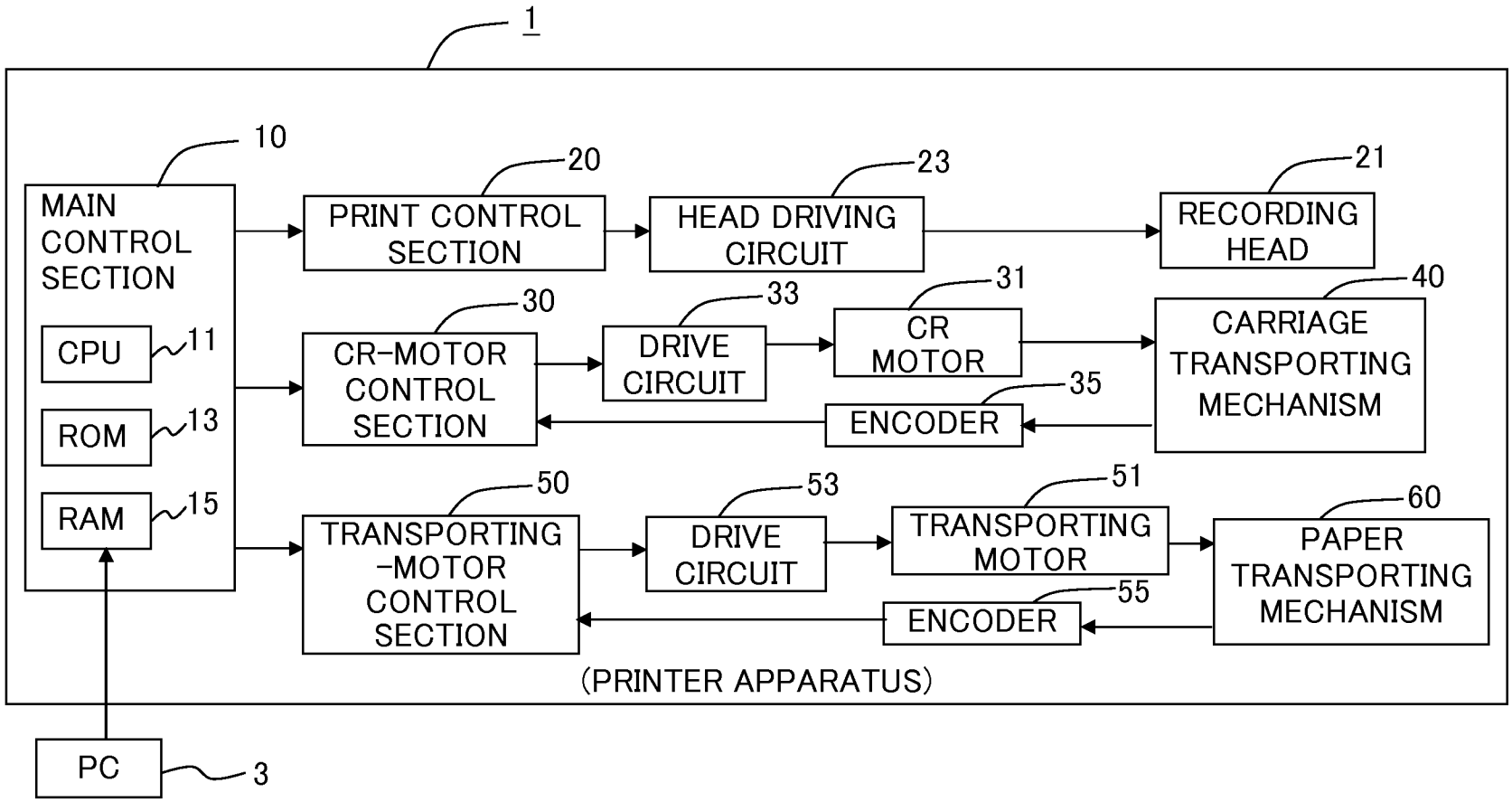
FIG. 1 is a block diagram indicating a configuration of a printer apparatus.

An exemplary embodiment of the present invention will be described below while referring to the accompanying diagrams. Printer apparatus 1 according to the embodiment is a so-called ink jet printer, and as shown in FIG. 1, includes a main control section 10, a print control section 20, a CR-motor control section 30, and a transporting-motor control section 50.

The main control section 10 includes a CPU (central processing unit) 11, a ROM (read only memory) 13 which stores a computer program which is to be executed by the CPU 11, and a RAM (random access memory) 15 which is used as a work area at the time of executing the computer program. The main control section 10 carries out an integrated control of the overall apparatus by executing a processing according to the computer program stored in the ROM 13 by the CPU 11. For instance, the main control section 10 is communicably connected to an external personal computer 3 via an interface which is not shown in the diagram, and controls each section of the apparatus such that a corresponding image is formed on a paper, based on image data subjected to printing which is input from the personal computer 3.

Whereas, the print control section 20 controls an operation of jetting of ink droplets by a recording head 21 via a head driving circuit 23. The recording head 21 in the printer apparatus 1 is structured similarly as a known inkjet head, and jets ink droplets from a nozzle group which is facing the paper, by an operation of a built-in piezoelectric body. Moreover, the head driving circuit 23 in the printer apparatus 1 drives the recording head 21 according to a control signal which is input from the print control section 20, and makes the recording head 21 jet the ink droplets by an operation mode according to the control signal.

The CR-motor control section 30 controls a CR motor (carriage driving motor) 31 via a drive circuit 33. The drive circuit 33 in the printer apparatus 1 applies a drive current according to a control signal from the CR-motor control section 30, to the CR motor 31, and drives the CR motor 31.

The CR motor 31 in the printer apparatus 1 is formed by a direct-current motor (DC motor), and is attached to a carriage transporting mechanism 40. The carriage transporting mechanism 40 receives a driving force from the CR motor 31 and transports a carriage 41 installed on the recording head 21, in a main scanning direction. A linear encoder 35 which outputs a pulse signal corresponding to a movement of the carriage 41 in the main scanning direction is fitted to the carriage 41.

The CR-motor control section 30 detects a position P, a velocity V, and an acceleration A of the carriage 41 based on an output signal of the linear encoder 35. Moreover, the CR-motor control section 30 carries out a feedback control of the CR motor 31 such that the carriage 41 moves in the main scanning direction in accordance with a target profile, based on values detected of the position P, the velocity V, and the acceleration A, and a position command value, a velocity command value, and an acceleration command value at each time indicated by a target profile of each of a position, a velocity, and an acceleration imparted from the main control section 10. Accordingly, the CR-motor control section 30 realizes a transportation control of the carriage 41 (and consequently of the recording head 21).

Moreover, the transporting-motor control section 50 controls a transporting motor 51 via a drive circuit 53. The drive circuit 53 in the printer apparatus 1 applies a drive current according to a control signal from the transporting-motor control section 50, and drives the drive motor 51.

The transporting motor 51 in the printer apparatus 1 is formed by a direction-current (DC) motor, and is attached to a paper transporting mechanism 60. The paper transporting mechanism 60 is arranged to transport a paper Q in a secondary scanning direction by rotation of rollers 62 and 65 (refer to FIG. 2) which rotate upon receiving a driving force from the transporting motor 51. A rotary encoder 55 which outputs a pulse signal corresponding to the rotation of the rollers 60 and 65 is fitted to the paper transporting mechanism 60.

Here, a concrete arrangement of the paper transporting mechanism 60 will be described below while referring to FIG. 2. The paper transporting mechanism 60 according to the embodiment includes a platen 61 which supports the paper Q from below, a pair of rollers namely a main roller 62 and a pinch roller 63, which is provided at an upstream side in the paper transporting direction of the platen 61, and a pair of rollers namely a paper discharge roller 65 and a pinch roller 66, which is provided at a downstream side in the paper transporting direction of the platen 61. The main roller 62, the pinch roller 63, the paper discharge roller 65 and the pinch roller 66 are provided in parallel to the main scanning direction (a normal direction of a paper surface in FIG. 2), and are installed such that the paper Q can be transported in a secondary scanning direction which is orthogonal to the main scanning direction.

In the paper transporting mechanism 60, an arrangement is made such that the main roller 62 and the paper discharge roller 65 rotate in synchronization upon receiving a driving force from the transporting motor 51. The paper Q which is supplied from an upstream side of the paper transporting direction is pinched between the main roller 62 and the pinch roller 63, and by the rotation of the main roller 62, the paper Q is transported to an upper-side area of the platen 61 which is a position of image formation by the recording head 21. The paper Q which has reached the paper discharge roller 65 is pinched between the paper discharge roller 65 and the pinch roller 66, and is discharged to a downstream side of the paper transporting direction by the rotation of the paper discharge roller 65. A paper is supplied to the main roller 62 by a rotation of a paper feeding roller for example, which is not shown in the diagram. The paper feeding roller is driven by the transporting motor 51 for example.

The rotary encoder 55 is fitted to a rotating shaft such as a rotating shaft of the transporting motor 51 or a rotating shaft of the main roller 62 of the paper transporting mechanism 60 which is arranged in such manner, and outputs a pulse signal corresponding to the rotation of the main roller 62 and the paper discharge roller 65.

The transporting-motor control section 50 detects the position P, the velocity V, and the acceleration A of the paper based on a signal output from the rotary encoder 55. Moreover, the transporting-motor control section 50 carries out a feedback control of the transporting motor 51 such that the paper moves in the secondary scanning direction in accordance with a target profile, based on the values detected of the position P, the velocity V, and the acceleration A, and the position command value, the velocity command value, and the acceleration command value at each time indicated by the target profile of position, the target profile of velocity, and the target profile of acceleration imparted from the main control section 10. By such motor control, the transporting-motor control section 50 realizes a control of transportation of the paper.

Next, an arrangement of the carriage transporting mechanism 40 will be described below concretely while referring to FIG. 2 and FIG. 3. The carriage transporting mechanism 40 according to the embodiment, as shown in FIG. 3, includes a driving pulley 43, a driven pulley 4, a belt 45, a frame 47 which includes a guide rail 47A extended in the main scanning direction, and a frame 49 which is extended in the main scanning direction. The driving pulley 43 and the driven pulley 44 are arranged in the frame 47 which is at a downstream side of the paper transporting direction (secondary scanning direction) for example.

The carriage 41 is fixed to the belt 45 which is put around the driving pulley 43 and the driven pulley 44, and moves in the main scanning direction by receiving indirectly a driving force from the CR motor 31 via the belt 45. The CR motor 31 is connected to the driving pulley 43 via gears, and the driving pulley 43 rotates by receiving a driving force generated by the CR motor 31, via the gears. Due to the rotation of the driving pulley 43, the belt 45 which is put around the driving pulley 43 and the driven pulley 44 rotates. A position at which the belt 45 is fixed to the carriage 41 is above the frame 47, and is at a downstream side in the secondary scanning direction, of a center of gravity of the carriage 41.

The carriage 41 is provided to be spread over the guide rail 47A and the frame 49, and a movement of the carriage 41 is regulated in the main scanning direction by the guide rail 47A. By such an arrangement, as the CR motor 31 rotates, the carriage 41 moves in the main scanning direction in conjunction with the rotation of the belt 45. Moreover, the carriage 41 is regulated in a vertical direction by the frames 47 and 49.

Here, a relationship of the guide rail 47A and the carriage 41 will be described in detail by using FIG. 2. FIG. 2 shows a state of the carriage 41 placed on the frames 47 and 49, and an enlarged view of an area around a groove portion 411 of the carriage 41 is shown in an area surrounded by alternate dotted and dashed lines in FIG. 2.

Figure 2:
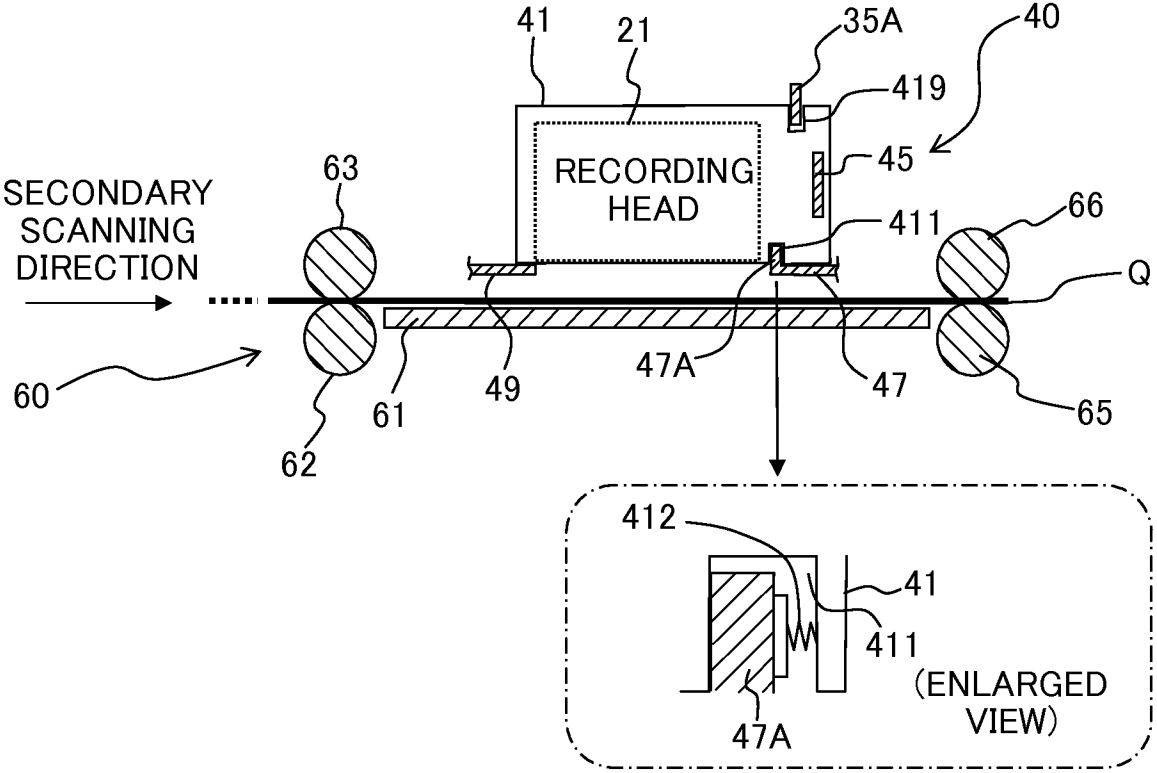
FIG. 2 is a diagram indicating an arrangement of a carriage transporting mechanism and a paper transporting mechanism.
Figure 3:
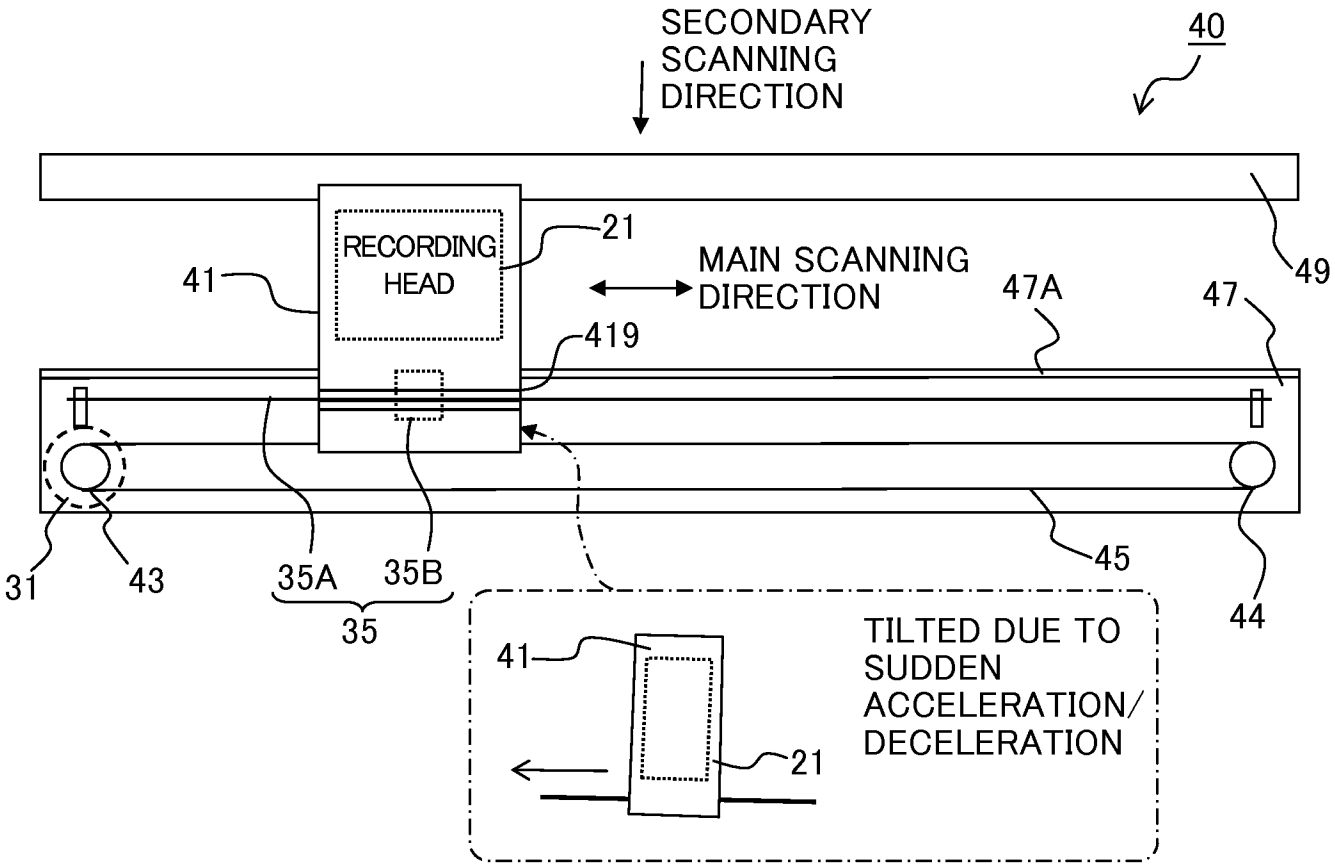
FIG. 3 is a plan view showing an arrangement of the carriage transporting mechanism.

As shown in FIG. 2, the carriage 41 has the groove portion 411 which is formed parallel to the main scanning direction, in a lower surface thereof, and an arrangement is made such that the guide rail 47A is inserted into the groove portion 411, and is installed on the frames 47 and 49. In the abovementioned state, the frames 47 and 49 make a contact with the lower surface of the carriage 41, and support the carriage 41 from below.

Moreover, a pressing portion 412 which is pressed against a side wall of the guide rail 47A by a bias applied by a spring, and which is slidable on the side wall is provided to the groove portion 411. The pressing portion 412 carries out a function of suppressing mistracking and tilting of the carriage 41 from the guide rail 47A. By such an arrangement, the carriage transporting mechanism 40 is capable of transporting the carriage 41 accurately in the main scanning direction.

As it is evident from FIG. 2, a groove portion 419 which is parallel to the main scanning direction is formed in an upper surface of the carriage 41, and an encoder scale 35A which forms the abovementioned linear encoder 35 is inserted into the groove portion 419 (refer to FIG. 3). Moreover, the groove portion 419 is provided with a sensor portion 35B which reads the encoder scale 35A. In other words, the linear encoder 35 includes the encoder scale 35A and the sensor portion 35B, and by the sensor portion 35B reading the encoder scale 35A with the movement of the carriage 41, the linear encoder 35 outputs a pulse signal corresponding to the movement of the carriage 41 in the main scanning direction.

As it has been mentioned above, although the pressing portion 412 provided to the groove portion 411 carries out the function of suppressing the mistracking and tilting of the carriage 41 from the guide rail 47A by the bias applied by the spring, there is a limitation to the bias which is applied by the spring. Therefore, in a case, in which a velocity of the carriage 41 is high for instance, it is not possible to suppress the mistracking and tilting of the carriage 41 by the bias applied by the spring.

In the embodiment, since the carriage 41 is transported in the main scanning direction by the belt 45, when the bias to be applied is weaker than an external force, the carriage 41 is tilted with respect to the main scanning direction in the form of an area near a portion of the carriage 41 coupled with the belt 45 being pulled in a direction of acceleration or deceleration (refer to a diagram inside an area surrounded by alternate dotted and dashed lines in FIG. 3). When the carriage 41 is tilted in such manner, there is a large error in a jetting position of ink droplets, and the quality of an image which is formed on the paper is degraded.

For such reason, in the embodiment, in a print interval which is an area in the transporting path of the carriage 41 extended in the main scanning direction, on which the ink droplets are jetted from the recording head 21, an acceleration and a deceleration of the carriage 41 is carried out at an acceleration |Au| which is lower than the maximum acceleration |Al| which can be realized by the CR motor 31.

Variables such as A, Au, and Al are used as variables which denote the acceleration. When the abovementioned variables are used, the acceleration is defined as a positive value and the deceleration is defined as a negative value. Moreover, in the embodiment, in a case of describing the acceleration by using a symbol || for an absolute value as for the acceleration |Al|, the description is referred to a magnitude (an absolute value) of the acceleration. Moreover, the term "deceleration" means a value, in which a sign for the acceleration is inverted, or in other words, the acceleration is defined as a negative value and the deceleration is defined as a positive value. The "maximum deceleration which can be realized by the CR motor 31" of the present teaching means maximum deceleration based on load torque of the CR motor 31 and maximum value of current which can be applied to the CR motor 31 to decelerate the carriage 41 by the drive circuit 33, when the carriage 41 is transported.

Next, a print processing including a control of transportation of the carriage 42 (the recording head 21) in the printer apparatus 1 according to the embodiment will be described below in detail. According to the present invention, similarly as in a hitherto known ink jet printer, when image data which is to be printed is input from the external personal computer 3, the main control section 10 controls each section of the printer apparatus 1 such that a corresponding image is formed on a paper, based on the image data which is subjected to printing.

Concretely, the main control section 10 controls each section of the printer apparatus 1 to form a line image on a paper, based on the image data which is subjected to printing, by making jet ink droplets from the recording head 21 while transporting the recording head 21 in the main scanning direction, up to a turn-around point, after transporting the paper in the secondary scanning direction by a predetermined amount every time. The main control section 10, by repeatedly carrying out such control, forms an image based on the image data subjected to printing which is made of a series of line images, on the paper.

For forming each line image, the main control section 10 sets a target profile in the transporting-motor control section 50. The transporting-motor control section 50 carries out a feedback control of the transporting motor 51 such that the paper is transported in the secondary scanning direction by a predetermined amount following a trajectory of movement according to the target profile.

As the transporting of the paper ends, the main control section 10 sets a target profile for the CR-motor control section 30. The CR-motor control section 30 carries out a feedback control of the CR motor 31 such that the carriage 41 is transported in the main scanning direction up to the turn-around point following the trajectory of movement according to the target profile.

Moreover, at the time of transporting the carriage 41, the main control section 10 imparts an image data of the line in the image data subjected to printing. The print control section 20 controls an operation of jetting ink droplets by the recording head 21 such that the corresponding line image is formed on the paper. For the control of the jetting operation, information of a position, a velocity, and an acceleration of the carriage 41 is imparted to the print control section 20.

Incidentally, since a landing position of the ink droplets on the paper is affected by the velocity of the recording head 21 at the time of jetting, generally, the carriage 41 is transported at a constant velocity, and while the carried 41 is being transported at a constant velocity, the recording head 21 is made to carry out the operation of jetting ink droplets. However, when such method is adopted, in the print interval, in which the operation of jetting the ink droplets by the recording head 21 is carried out, it is necessary to transport the carriage 41 at a constant velocity. Therefore, deceleration of the carriage 41 has to be started after the carriage 41 has got out of the print interval, and it is necessary to make the transporting path of the carriage 41 (hereinafter expressed as "carriage transporting path") in the main scanning direction longer than a width of the paper, by an amount of a distance necessary for deceleration. Due to this, small-sizing of the printer apparatus 1 is inhibited.

Therefore, in the embodiment, while setting the carriage transporting path short on one hand, a point which is isolated away from a turn-around point Pe of the carriage 41 only by a distance Du upon taking into consideration the distance necessary for deceleration at an upstream side of the transporting direction of the carriage 41 is to be determined as a deceleration-starting point Pd. In a case, in which an end point Pa of the print interval is at a downstream side in the transporting direction of the carriage 41 than the deceleration-starting point Pd, an image is formed on the paper by making the recording head 21 carry out the operation of jetting the ink droplets while decelerating the carriage 41 from the deceleration-starting point Pd up to a print-interval end point Pa.

In other words, till the carriage 41 reaches the deceleration-starting point Pd, an image is formed on the paper by making the recording head 21 jet ink droplets while transporting the carriage 41 at a constant velocity, and from the deceleration-starting point Pd up to the print-interval end point Pa, an image is formed on the paper by making the recording head 21 jet ink droplets while decelerating the carriage 41. Hereinafter, an interval in the carriage transporting path from the deceleration-starting point Pd up to the print-interval end point Pa is expressed as a "deceleration print interval".

However, in the deceleration print interval, when the deceleration becomes excessively large as mentioned above, the recording head 12 is tilted together with the carriage 4, and there is an adverse effect on the quality of image formed on the paper. Therefore, in the embodiment, taking into consideration the spring bias applied by the pressing portion 412, an acceleration |Au| of a degree which is capable of suppressing sufficiently the possibility of tilting of the recording head 21 thereby affecting the image quality adversely, is to be calculated in advance by tests etc., and the acceleration |Au| is set as a limit value of the acceleration in the print interval.

In other words, in the deceleration print interval (interval 1 shown in FIG. 5 and FIG. 6) according to the present invention, a peak of the acceleration is set to be |Au|, and the recording head 21 is made to jet ink droplets while decelerating the carriage 41 with a corresponding acceleration trajectory.

Figure 5:
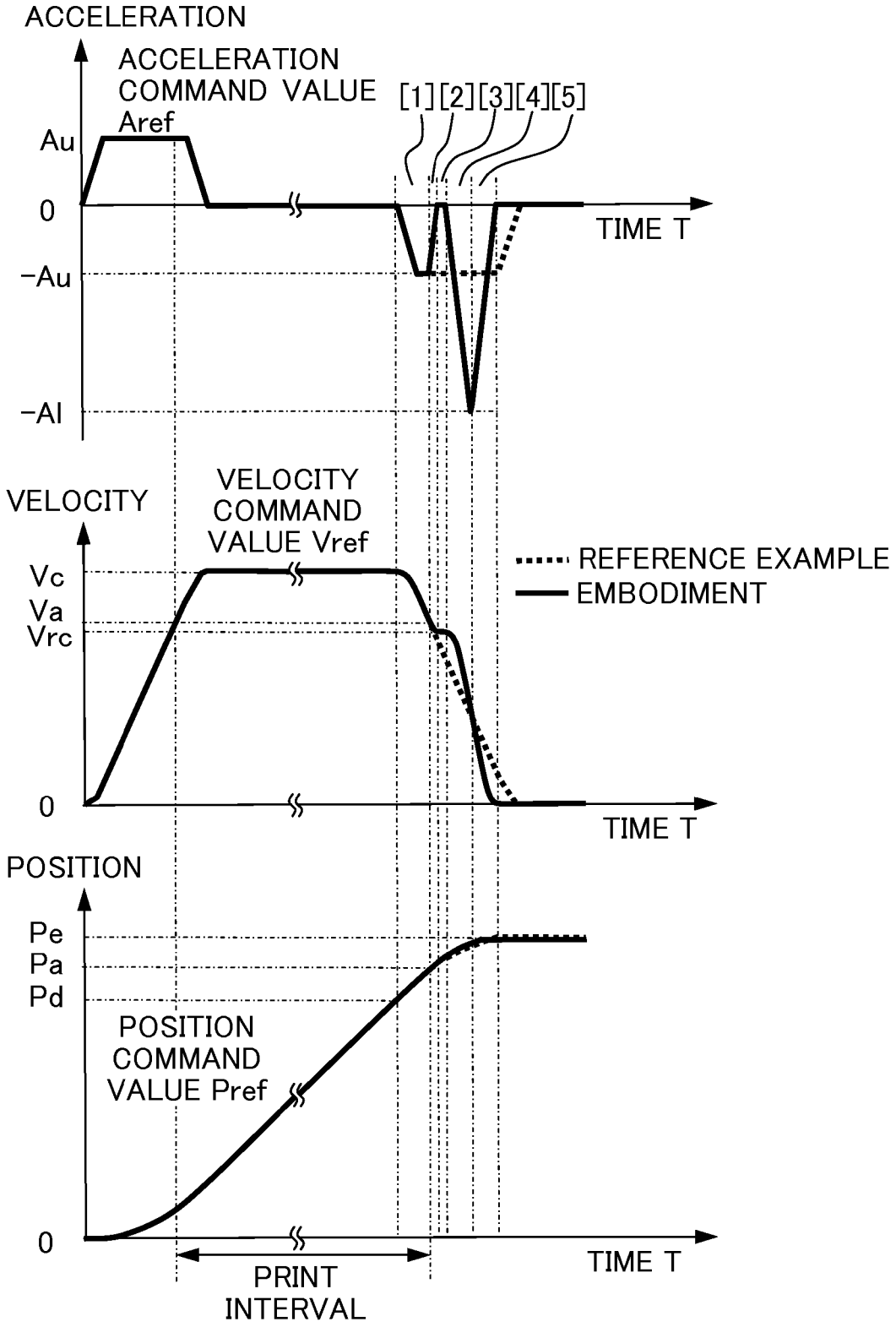
FIG. 5 is a diagram showing a trajectory of each of an acceleration command value, a velocity command value, and a position command value indicated by each of an acceleration profile, a velocity profile, and a position profile which are set in a case that the deceleration-starting point is at the upstream side of the carriage transporting direction than the print-interval end point.

In FIG. 5, an acceleration command value Aref, a velocity command value Vref, and a position command value Pref till the carriage 41 reaches the turn-around point Pe from the deceleration-starting point of the carriage 41 are indicated by solid lines, and the acceleration command value Aref, the velocity command value Vref, and the position command value Pref according to a reference example till the carriage 41 reaches the turn-around point Pe from the deceleration-starting point of the carriage are indicated by dotted lines. Moreover, in FIG. 6, trajectory of an area around an interval from the deceleration-starting point Pd up to the turn-around point Pe for each of the acceleration command value Aref, the velocity command value Vref, and the position command value Pref is shown to be enlarged. However, a trajectory of a dotted line in a time zone in which the dotted line is missing in FIG. 5 and FIG. 6 coincides with the solid line.

Figure 6:
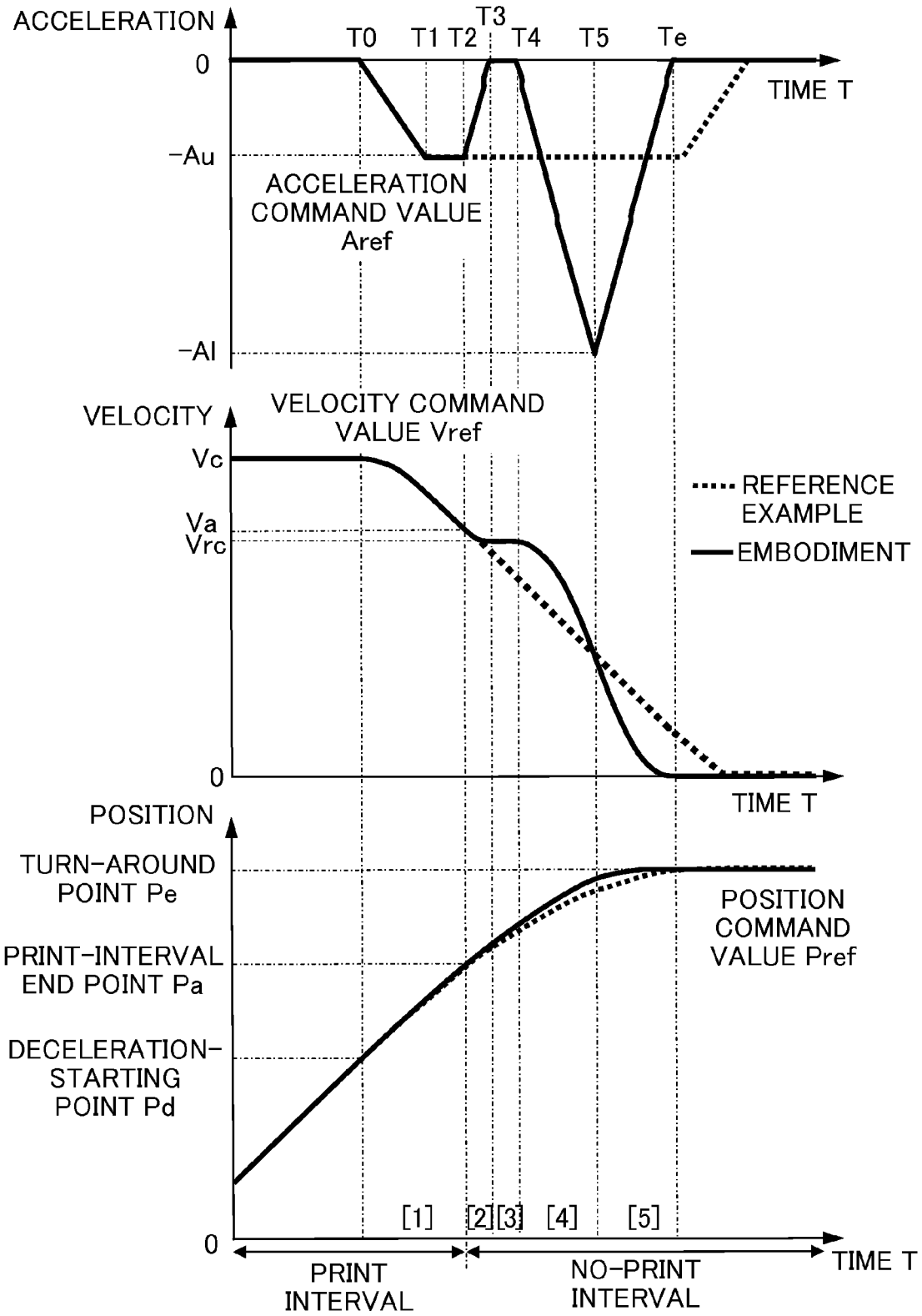
FIG. 6 is a diagram, in which the trajectory of each of the acceleration command value, the velocity command value, and the position command value in the case that the deceleration-starting point is at the upstream side of the carriage transporting direction than the print-interval end point is indicated in an enlarged form.

The distance Du which defines the deceleration-starting point Pd corresponds to an amount of displacement of the carriage 41 from a point of time at which the carriage 41 is started to be decelerated from a state of the constant velocity, following the acceleration trajectory for which the acceleration peak indicated by the solid line in FIG. 5 and FIG. 6 is let to be |Au| till the carriage 41 stops. The distance Du is stored in advance in a register etc. which is not shown in the diagram, for each velocity and acceleration peak |Au| in the state of a constant velocity.

Moreover, as it is evident from the reference example (dotted lines), in a deceleration no-print interval which is an interval from the print-interval end point Pa up to the turn-around point Pe, when the carriage 41 is decelerated following the acceleration trajectory of the acceleration peak |Au|, the carriage 41 is decelerated gradually and stopped, and time necessary till the carriage 41 stops becomes long.

Therefore, in the embodiment, the deceleration no-print interval has been divided into a deceleration relaxation interval (interval [2] shown in FIG. 5 and FIG. 6), a resumed constant-velocity interval (interval [3] shown in FIG. 5 and FIG. 6), and a re-deceleration interval (intervals [4] and [5] shown in FIG. 5 and FIG. 6). Moreover, by stopping the carriage 41 once in the deceleration relaxation interval and the resumed constant-velocity interval, and by re-decelerating the carriage 41 following the acceleration trajectory for which the maximum acceleration |Al| which can be realized by the CR motor 31 is let to be the acceleration peak, in the re-deceleration interval, the time taken by the carriage 41 to stop from the deceleration-starting point Pd has been made short.

Figure 4A:
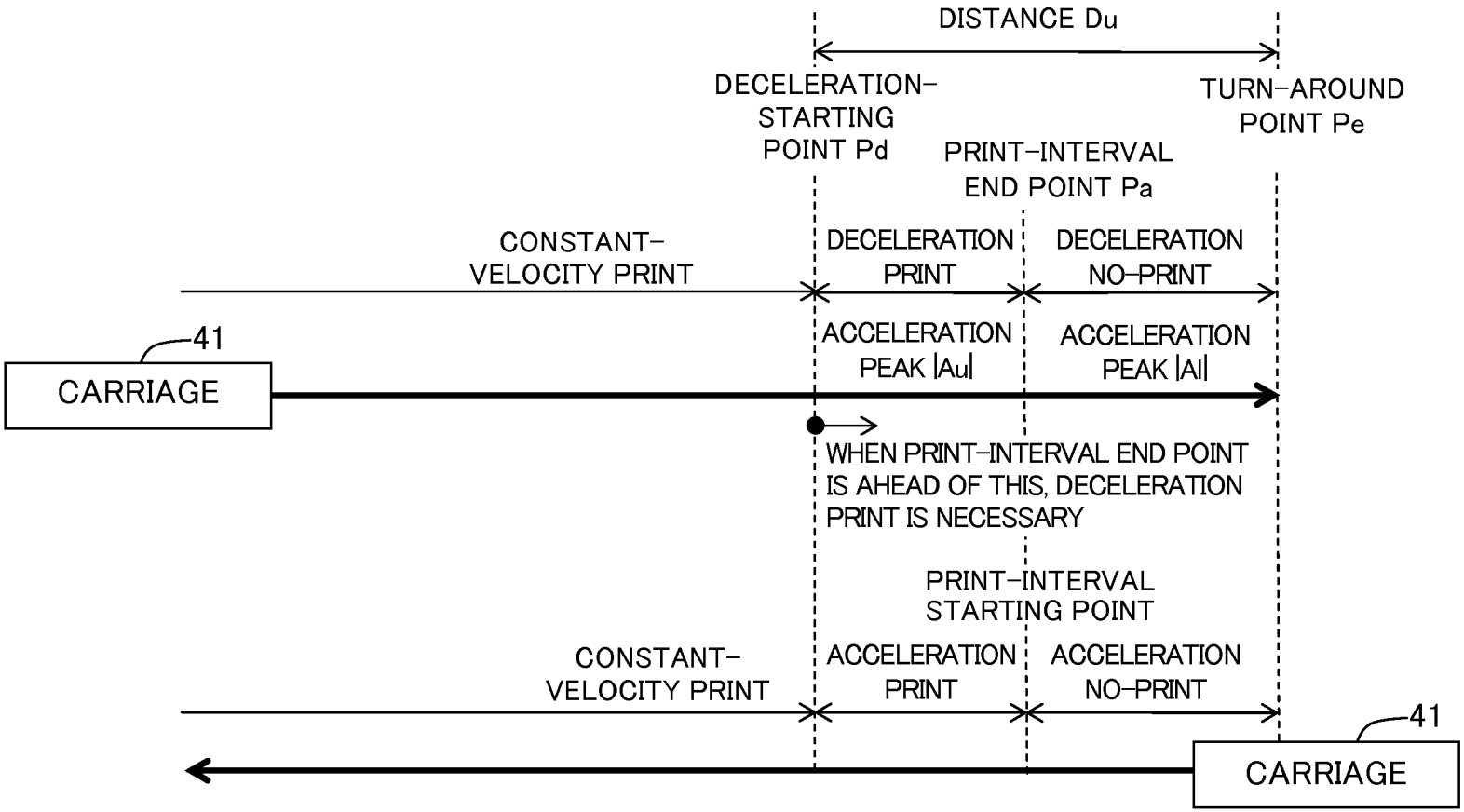
FIG. 4A is a diagram showing how a carriage accelerates/decelerates in an area around a turn-around point of the carriage in a case that a deceleration-starting point is at an upstream side of a carriage transporting direction than a print-interval end point.
Figure 4B:
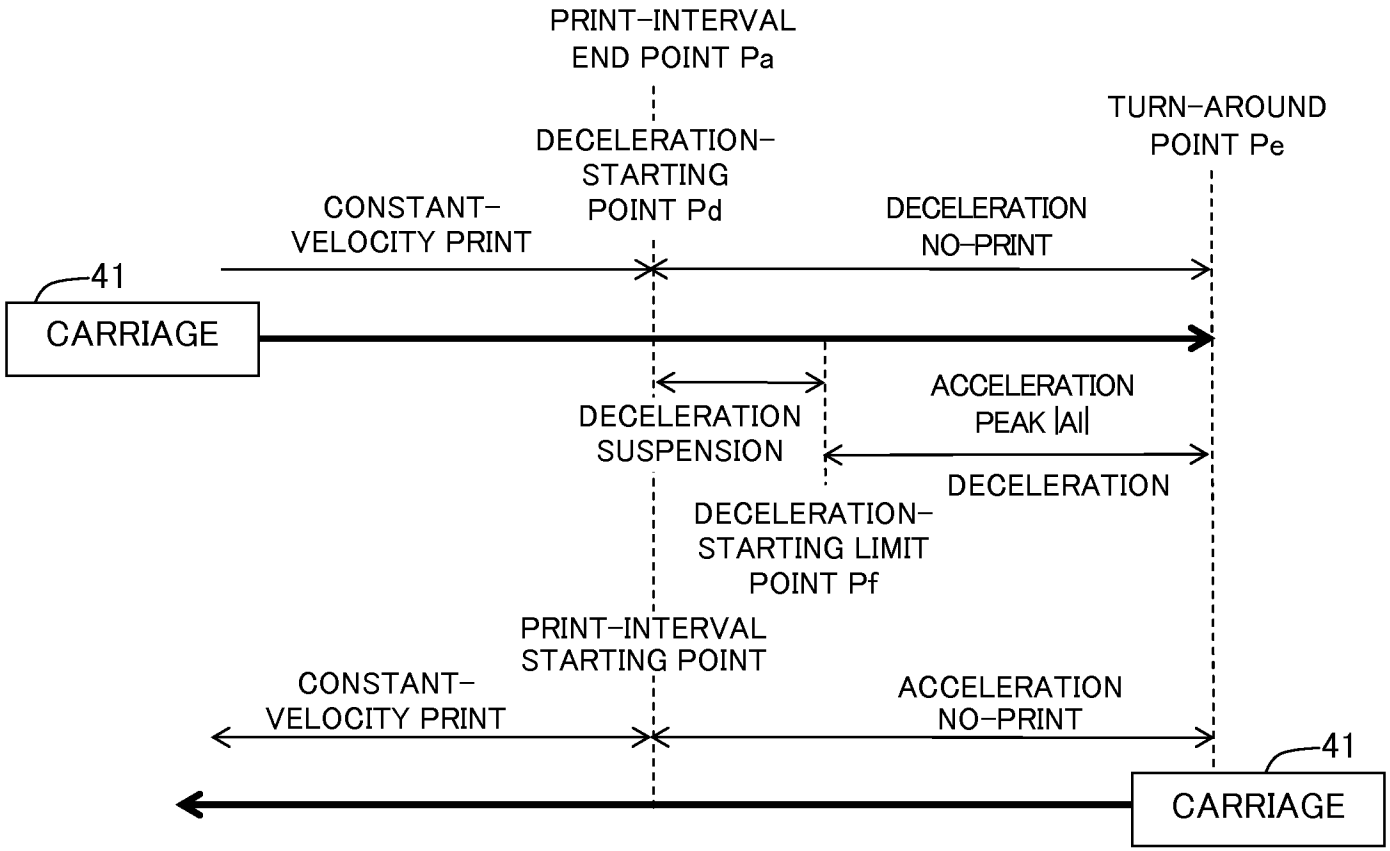
FIG. 4B is a diagram showing how the carriage accelerates/decelerates in an area around the turn-around point of the carriage in a case that the deceleration-starting point coincides with the print-interval end point.
Figure 7:
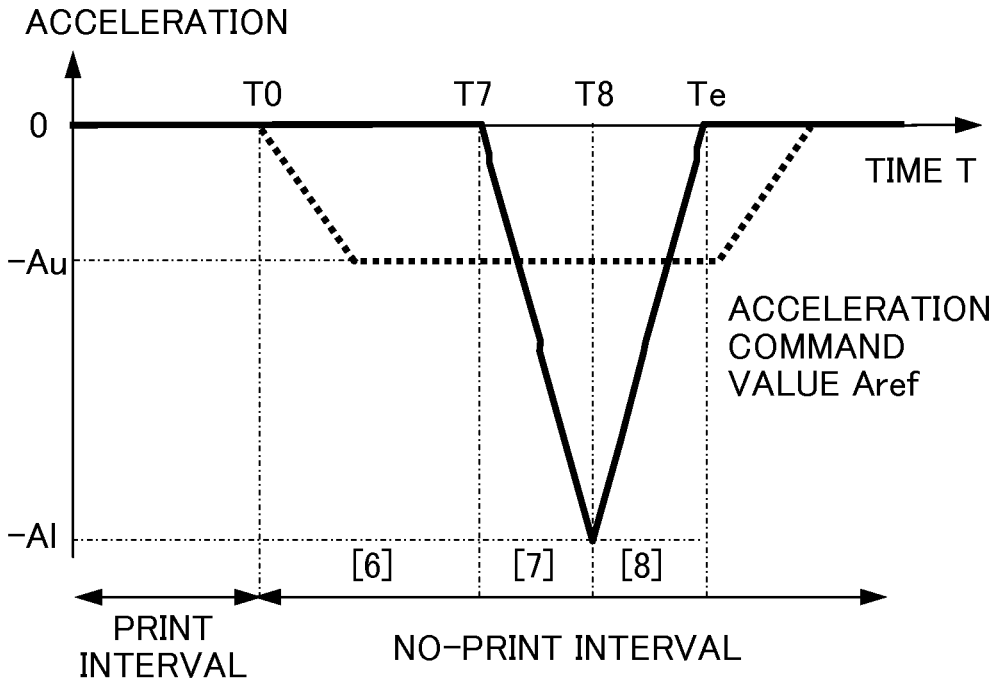
FIG. 7 is a diagram, in which the trajectory of the acceleration command value in the case that the deceleration-starting point is at the print-interval end point or at the upstream side in the carriage transporting direction than the print-interval end point is indicated in an enlarged form.

On the other hand, in the embodiment, as shown in FIG. 4B, in a case, in which the deceleration-starting point Pd coincides with the print-interval end point Pa, and in a case, in which the deceleration-starting point Pd is positioned on the downstream side in the transporting direction of the carriage 41, than the print-interval end point Pa, the carriage 41 is transported at a constant velocity till the carriage 41 reaches the deceleration-starting point Pd, and from a time T0 at which the carriage 41 has passed the deceleration-starting point Pd, the carriage 41 is decelerated following the acceleration trajectory indicated by a solid line in FIG. 7, and the carriage 41 is stopped at the turn-around point Pe.

Concretely, in the embodiment, for suppressing the time required till stopping the carriage 41, up to a time T7 at which the carriage 41 reaches a deceleration-starting limit point Pf which is isolated to be away toward the upstream side in the transporting direction of the carriage 41, from the turn-around point Pe, only by a distance D1 which is necessary for stopping after decelerating the carriage 41 from a constant-velocity state to the acceleration peak |Al|, the deceleration is suspended even after passing the deceleration-starting point Pd, and the carriage 41 is continued to be transported at a constant velocity. Hereinafter, an interval from the deceleration-starting point Pd up to the deceleration-starting limit point Pf (interval [6] in FIG. 7) will be expressed as a "deceleration-suspension interval".

Further, the carriage 41 is decelerated following the acceleration trajectory for which the acceleration peak is let to be |Al| from a point of time at which the carriage 41 has passed the deceleration-starting limit point Pf, and then the carriage 41 is stopped at the turn-around point Pe (intervals [7] and [8] shown in FIG. 7). In the embodiment, by carrying out a deceleration control corresponding to each case in such manner, the time required to decelerate and stop the carriage 41 is shortened.

The turn-around point Pe is determined by the current print interval and a print interval of the subsequent line. Therefore, it is not that stopping the carriage 41 upon decelerating immediately at the acceleration peak |Al|, from the print interval end point Pa will serve the purpose.

Moreover, at the time of controlling the transportation of the carriage 41 from the turn-around point Pe for an image formation of the subsequent line, as shown in FIG. 4A, FIG. 4B, and FIG. 5, from the turn-around point Pe of the previous line which is a transportation-starting point, up to a point where the carriage 41 attains a velocity Vc at the time of transporting at a constant velocity, the carriage 41 is accelerated following the acceleration trajectory for which the acceleration peak is let to be |Au|. However, in a case, in which a starting point of the print interval is at a downstream side in the transporting direction of the carriage 41 than the point at which the carriage 41 attains the velocity Vc at the time of transporting at a constant velocity (refer to FIG. 4A), from that starting point up to a starting point of a constant-velocity transporting control, the recording head 21 is made to carry out the operation of jetting the ink droplets while accelerating the carriage 41. In the embodiment, an image based on image data to be printed on a paper is formed by making the recording head 21 jet the ink droplets in the print interval while reciprocating the carriage 41 having the recording head 21 installed thereon, in the main scanning direction.

Next, a transportation-setting processing which the main control section 10 carries out for setting a target profile (trajectory of each of the acceleration command value Aref, the velocity command value Vref, and the position command value Pref) from the transportation-starting point up to the turn-around point Pe as shown in FIG. 5, FIG. 6, and FIG. 7, will be described below while referring to FIG. 8.

Figure 8A:
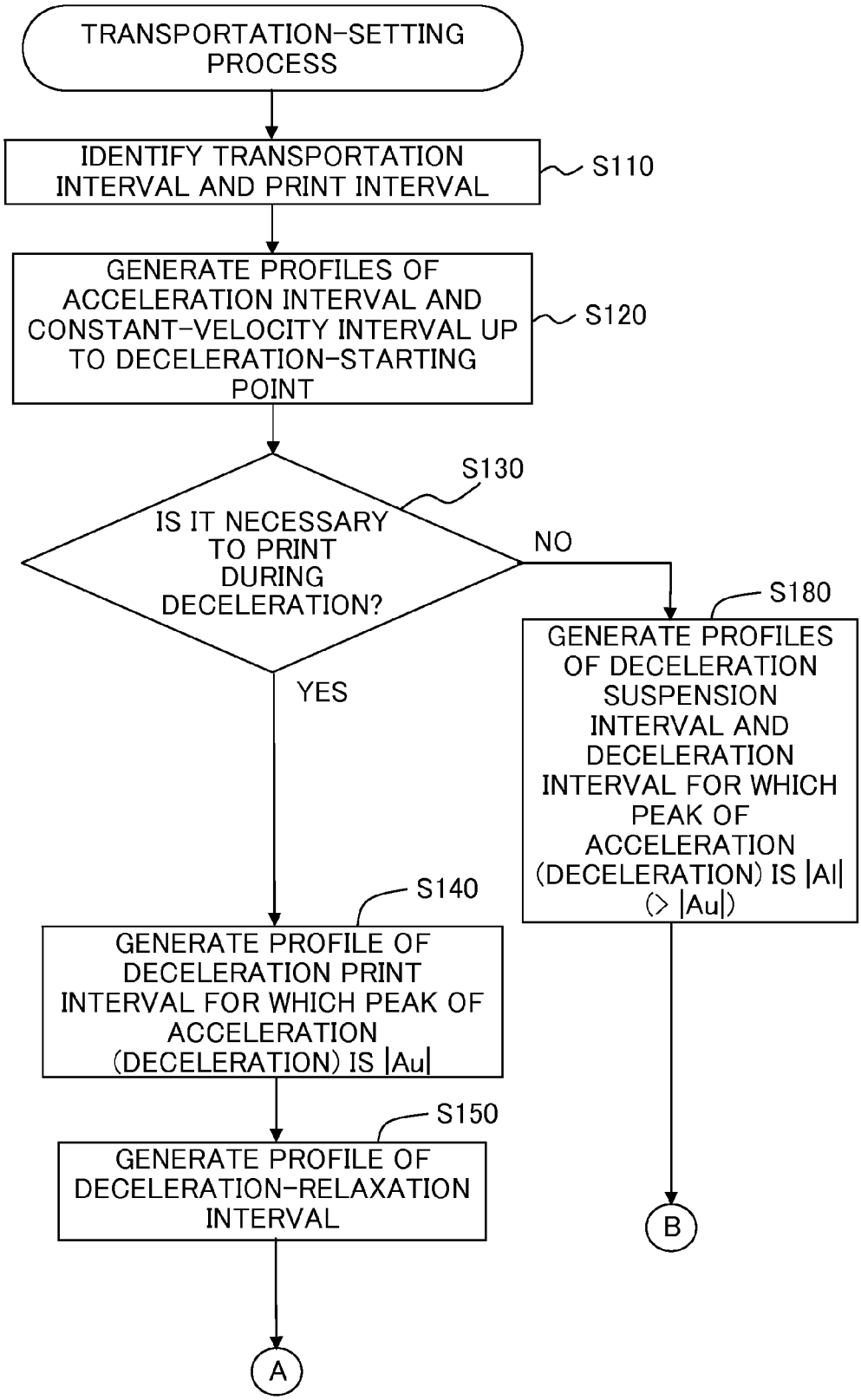
FIGS. 8A and 8B show a flowchart of transportation-setting processing which is carried out by a main control section.
Figure 8B:
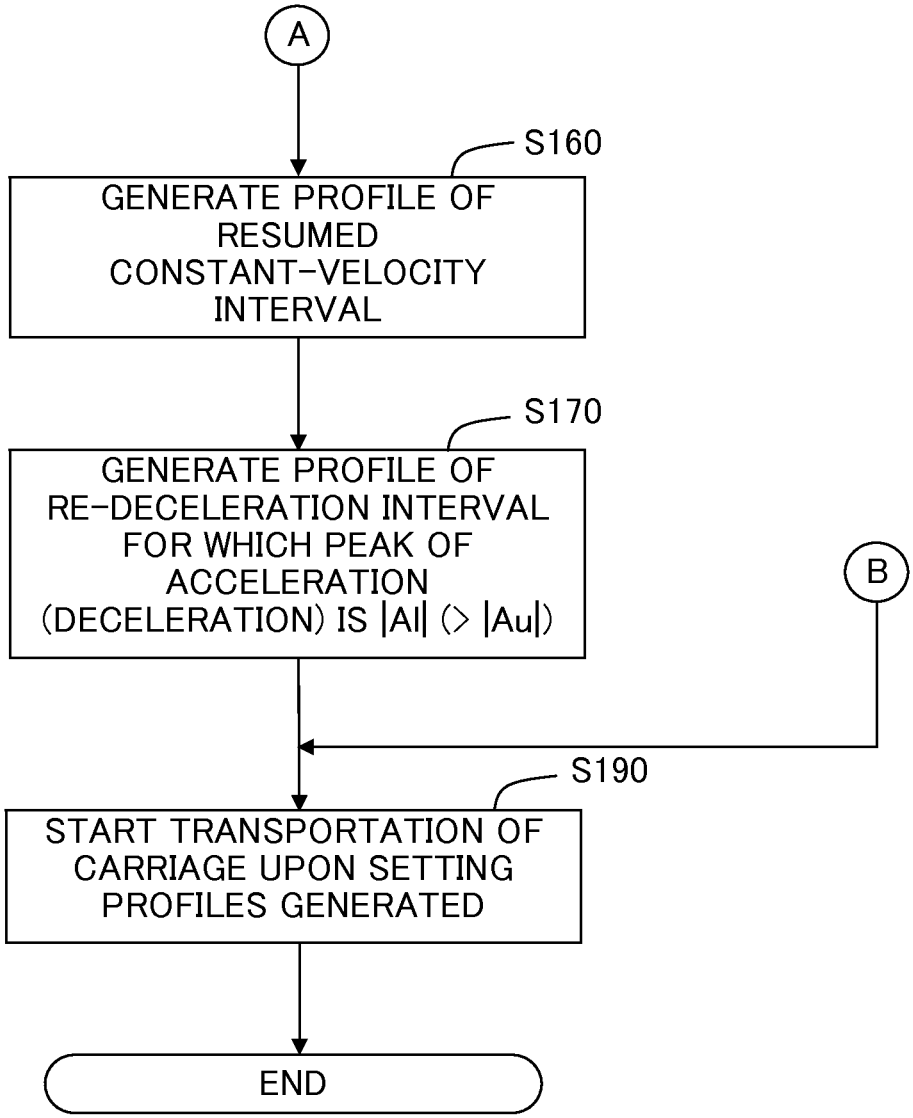

As the transportation-setting processing shown in FIG. 8 starts, the main control section 10, to start with, identifies a transportation interval of the carriage 41 for which the target profile is to be set, and identifies a print interval in the transportation interval (step S110). Then, the main control section 10 generates a target profile of an acceleration interval and a constant-velocity interval from the transportation-starting point (current point) of the carriage 41 which is a starting point of the transportation interval, up to the deceleration-starting point Pd (step S120). The deceleration starting point Pd is a point at near side at a predetermined distance Du from the turn-around point Pe which is an end point of the transportation interval as mentioned above.

Concretely, at step S120, the main control section 10 generates an acceleration profile indicating a trajectory of an acceleration command value Aref(T) up to the deceleration-starting point Pd, a velocity profile indicating a trajectory of a velocity command value Vref(T) up to the deceleration-starting point, a position profile indicating a trajectory of a position command value Pref(T) up to the deceleration starting point Pd as shown in FIG. 5, as target profiles of the acceleration interval and the constant-velocity interval. It is possible to form each profile as time-series data of the corresponding command value.

Thereafter, the main control section 10 makes a judgment of whether or not an operation of jetting the ink droplets associated with the deceleration of the carriage 41 is necessary, by making a judgment of whether or not the deceleration-starting point Pd is at the upstream side in the transporting direction of the carriage 41, than the print-interval end point Pa (step S130).

Further, as the main control section 10 makes a judgment at step S130 that the operation of jetting the ink droplets associated with the deceleration of the carriage 41 is necessary, the main control section 10 generates a target profile of the deceleration print interval which starts from the deceleration-starting point Pd for which the acceleration peak is let to be |Au| (step S140). Concretely, by using a relationship, jerk |Ju|=Ju (>0) and a relationship acceleration limit value |Au|=Au (>0) which have been determined in advance for the print interval, the main control section 10 generates an acceleration profile indicating a trajectory of the acceleration command value Aref(T) in the deceleration print interval according to the subsequent function, as one of the target profiles. It is possible to form the acceleration profile as time-series data of the acceleration command value Aref(T).

$$Aref(T)=-Ju*(t-T0)(T0<T\leq T1)$$

$$Aref(T)=-Au(T1<T\leq T2)$$

Time T which is indicated here is a time at which transportation-starting time is let to be zero, and time T0 indicates a time at which, the carriage 41 reaches the deceleration-starting point Pd. Time T1 is a time at which, the acceleration command value Aref(T) reaches −Au, and is indicated by T1=T0+Au/Ju. Time T2 indicates a time at which the carriage 41 reaches the print-interval end point Pa. Moreover, jerk |Ju| in the print interval is determined to be a jerk of a degree which does not affect adversely the quality of the image formed on the paper, by tests etc. similarly as the acceleration peak |Au|.

Furthermore, the main control section 10, by integrating the acceleration command value Aref(T) with respect to time, generates a velocity profile indicating a trajectory of the velocity command value Vref(T) in the deceleration print interval (time T0<T≤T2) as one of the target profiles.

$$Vref(T)=\int Aref(T)dt+Vc(T0<T\leq T2)$$

Here, an integral interval is [T0, T], and the velocity command value Vref(T) is defined as a value which takes a positive value in the transporting direction of the carriage 41. It is possible to form this velocity profile as time-series data of the velocity command value Vref(T). Moreover, a variable Vc in the above-mentioned expression denotes a velocity of the carriage 41 at time T0, or in other words, a velocity of the carriage 41 in a constant-velocity interval.

Apart from this, the main control section 10, by integrating the velocity command value Vref(T) with respect to time, generates a position profile which indicates a trajectory of the position command value Pref(T) in the deceleration print interval (time T0<T≤T2), as one of the target profiles.

$$Pref(T)=\int Vref(T)dt+Pd(T0<T\leq T2)$$

Here, an integral interval is [T0, T], and the position command value Pref(T) is defined as a value which takes a positive value in the transporting direction of the carriage 41. It is possible to form this velocity profile as time-series data of the position command value Pref(T). Moreover, a variable Pd in the above-mentioned expression denotes positional coordinates of the deceleration-starting point Pd for which the transportation-starting point is let to be a point of origin. Hereinafter, at the time of using a reference numeral (symbol) assigned to each point as a variable in an expression, that variable is let to be a variable which indicates positional coordinates of the point to which the reference numeral is assigned.

Moreover, after carrying out step S140, the main control section 10 generates a target profile of the deceleration relaxation interval (interval [2] shown in FIG. 5 and FIG. 6) which is in continuity with the deceleration print interval. Concretely, the main control section 10 generates an acceleration profile indicating a trajectory of an acceleration command value Aref(T) according to the subsequent function, by using a relationship |Jl|=Jl (>Ju) which has been determined in advance for the no-print interval (step S150).

$$Aref(T)=Jl*(t-T2)-Au(T2<T\leq T3)$$

Here, time T3 is a time at which the acceleration command value Aref(T) reaches zero, and is expressed by T3=T2+Au/Jl. Moreover, the jerk |Jl| in the no-print interval is determined to be the maximum jerk of the carriage 14 which is realizable by the CR motor 31.

Moreover, the main control section 10, by integrating the acceleration command value Aref(T) with respect to time, generates a velocity profile indicating a trajectory of the velocity command value Vref(T) in the deceleration relaxation interval (time T2<T≤T3). Furthermore, the main control section 10, by integrating the velocity command value Vref (T) with respect to time, generates a position profile indicating a trajectory of the position command value Pref(T) in the deceleration relaxation interval (time T2<T≤T3). The integration interval is [T2, T].

$$Vref(T)=\int Aref(T)dt+Va(T2<T\leq T3)$$

$$Pref(T)=\int Vref(T)dt+Pa(T2<T\leq T3)$$

Here, the variable Va used in the abovementioned expression denotes a velocity command value Va=Vref (T2) of the carriage 41 at a print-interval end point Pa=Pref(T2).

Moreover, after carrying out step S150, the main control section 10 generates a target profile of the resumed constant-velocity interval (interval [3] in FIG. 5 and FIG. 6) which is in continuity with the deceleration relaxation interval (step S160). An amount of displacement Drd of the carriage 41 in the re-deceleration interval which is in continuity with the resumed constant-velocity interval is determined uniquely by a velocity Vrc=Vref(T3) of the carriage 41 in the resumed constant-velocity interval. Therefore, from the amount of displacement Drd of the carriage 41 in the re-deceleration interval and a remained transporting amount Drs=(Pe−Pref (T3)), up to the turn-around point Pe at a starting point of the resumed constant-velocity interval, the main control section 10 calculates an amount of transporting Drc of the carriage 41 as Drc=Drs−Drd, by which the carriage 41 is to be transported in the resumed constant-velocity interval. From the amount of transporting Drc of the carriage 41 and a velocity Vrc of the carriage 41, the main control section 10 calculates duration ΔTrc of the resumed constant-velocity interval as ΔTrc=Drc/Vrc, and generates a target profile (acceleration profile, velocity profile, and position profile) of the acceleration command value Aref(T), the velocity command value Vref(T), and the position command value Pref(T) in the resumed constant-velocity interval (time T3<T≤T4=T3+ΔTrc) according to the subsequent function.

$$Aref(T)=0(T3<T\leq T4)$$

$$Vref(T)=Vrc=Vref(T3)(T3<T\leq T4)$$

$$Pref(T)=Vrc*(T-T3)+Pref(T3)(T3<T\leq T4)$$

In the embodiment, an environment, in which the amount of transporting of the carriage Drc which is to be transported in the resumed constant-velocity interval is not less than zero in any case, has been assumed.

Moreover, after the processing at step S160, the main control section 10 generates a target profile of the re-deceleration interval (intervals [4] and [5] in FIG. 5 and FIG. 6) which is in continuity with the resumed constant-velocity interval for which the acceleration peak is let to be |Al| (>|Au|). Concretely, by using the acceleration limit value |Al|=Al and the jerk |Jl| in the no-print interval, the main control section 10 generates a target profile (acceleration profile) for the acceleration command value Aref(T) according to the subsequent function.

$$Aref(T)=-Jl*(t-T4)(T4<T\leq T5)$$

$$Aref(T)=Jl*(t-T5)-Al(T5<T\leq Te)$$

Here, time T5 is expressed as T5=T4+Al/Jl, and denotes a time at which, the acceleration command value Aref(T)

reaches −Al which is a peak on a deceleration side, and time Te denotes a time at which, the carriage 41 reaches the turn-around point Pe, and is expressed by Te=T4+2*Al/Jl.

Moreover, the main control section 10, by integrating the acceleration command value Vref(T) with respect to time, generates a target profile (velocity profile) for the velocity command value Vref(T) in the re-deceleration interval (time T4<T≤Te), and by integrating the velocity command value Vref(T) with respect to time, generates a target profile (position profile) for the position command value Pref(T) in the re-deceleration interval (time T4<T≤Te). The integral interval is [T4, T].

$$Vref(T)=\int Aref(T)dt+Vrc(T4<T\geq Te)$$

$$Pref(T)=\int Vref(T)dt+Pref(T4)(T4<T\leq Te)$$

Thereafter, the main control section 10, upon setting the target profiles from the time T=0 to the time T=Te generated in such manner, in the CR-motor control section 30, makes the CR-motor control section 30 start a feedback control according to the target profiles (step S190), and terminates the transportation-setting processing. Accordingly, the carriage 41 is transported up to the turn-around point Pe following the acceleration trajectory, the velocity trajectory, and the position trajectory according to the target profiles shown in FIG. 5 and FIG. 6. Moreover, while the carriage 41 is being transported, the main control section 10 makes the recording head 21 carry out the operation of jetting ink droplets in the print interval, via the print control section 20, and forms a line image based on the image data which is subjected to printing on the paper.

On the other hand, when the main control section 10 makes a judgment at step S130 that the operation of jetting ink droplets associated with the deceleration of the carriage 41 is not necessary, the main control section 10, at step S180, generates a target profile of the deceleration-suspension interval (interval [6] in FIG. 7) which starts from the deceleration-starting point Pd, and the deceleration intervals (intervals [7] and [8] in FIG. 7) which are in continuity with the deceleration-suspension interval.

As it has been mentioned above, the end point of the deceleration-suspension interval is the deceleration-starting limit point Pf which is determined uniquely by the velocity V=Vc=Vref(T0) of the carriage in the constant-velocity interval. Therefore, the main control section 10 first calculates an amount of transporting Dk=(Pf−Pd) of the carriage 41 to be transported in the deceleration-suspension interval, and then calculates a duration ΔTk=Dk/Vc of the deceleration-suspension interval, from the amount of transporting Dk and the velocity Vc of the carriage 41 in the constant-velocity interval. Moreover, the main control section generates a target profile (acceleration profile, velocity profile, and position profile) for the acceleration command value Aref(T), the velocity command value Vref(T), and the position command value Pref(T) in accordance with the subsequent function, as a target profile of the deceleration-suspension interval.

$$Aref(T)=0(T0<T\leq T7)$$

$$Vref(T)=Vc(T0<T\leq T7)$$

$$Pref(T)=Vc*(T-T0)+Pd(T0<T\leq T7)$$

Here, time T7 is expressed as T7=T0+ΔTk, and is a time at which the carriage 41 reaches the deceleration-starting limit point Pf.

Furthermore, the main control section 10 generates a target profile for the acceleration command value Aref(T), the velocity command value Vref(T), and the position command value Pref(T) in accordance with the subsequent function, as a target profile of the deceleration interval which is in continuity with the deceleration-suspension interval.

$$Aref(T)=Jl*(t-T7)(T7<T\leq T8)$$

$$Aref(T)=Jl*(t-T8)-Al(T8<T\leq Te)$$

$$Vref(T)=\int Aref(T)dt+Vc(T7<T\leq Te)$$

$$Pref(T)=\int Vref(T)dt+Pf(T7<T\leq Te)$$

Here, time T8 is a time at which the acceleration command value Aref(T) reaches −Al which is a peak of deceleration side, and is expressed as T8=T7+Al/Jl. Time Te is a time at which, the carriage 41 reaches the turn-around point Pe, and is expressed as Te=T7+2*Al/Jl.

Thereafter, the main control section 10, upon setting the target profiles from the time T=0 to the time T=Te generated in such manner, in the CR-motor control section 30, starts the feedback control according to the target profiles (step S190), and then terminates the transportation-setting processing. Accordingly, the carriage 41 is transported up to the turn-around point Pe following the acceleration trajectory, the velocity trajectory, and the position trajectory according to the target profiles shown in FIG. 7.

As it has been heretofore described, in the printer apparatus 1 according to the embodiment, at the time of transporting the recording head 21 up to the turn-around point Pe in the carriage transporting path by controlling the carriage transporting mechanism 40, the carriage transporting mechanism 40 is controlled such that the recording head 21 decelerates from the deceleration-starting point Pd which is an upstream side of the turn-around point Pe in the transporting direction of the carriage 41. Concretely, the carriage transporting mechanism 40 is controlled such that, with the print-interval end point Pa positioned between the deceleration-starting point Pd and the turn-around point Pe as a base, in a deceleration no-print interval from the print-interval end point Pa up to the turn-around point Pe, the peak of acceleration becomes higher than a peak of acceleration in the deceleration print interval from the deceleration-starting point Pd up to the print-interval end point Pa.

In other words, in the deceleration print interval, the main control section 10 controls the carriage transporting mechanism 40 such that the recording head 21 decelerates according to the acceleration profile in interval [1] shown in FIG. 5 and FIG. 6. Whereas, in the deceleration no-print interval, the main control section 10 controls the carriage transporting mechanism 40 such that the recording head 21 decelerates according to the acceleration profile of intervals [2], [3], [4], and [5] (hereinafter, "intervals [2] to [5]") in FIG. 5 and FIG. 6 with even higher peak of deceleration.

In case of carrying out deceleration by using the acceleration peak |Au| in the no-print interval, similarly as in the print interval, there is a drawback that it takes time to decelerate and stop the recording head 21. However, in the embodiment, by setting the acceleration peak in the deceleration no-print interval to the maximum acceleration (deceleration) |Al| which is realizable by the CR motor 31, and not to the acceleration peak |Au|, in which the effect on the image quality is taken into consideration, it is possible to transport the carriage 41 and the recording head 21 at a high velocity from the deceleration-starting point Pd up to the turn-around point Pd, and stop.

Consequently, according to the embodiment, it is possible to transport the recording head 21 at a high-velocity up to the turn-around point while maintaining a favorable image quality, and to improve the throughput of the print processing. In other words, according to the embodiment, it is possible to provide the printer apparatus 1 which is superior from points of quality, high-speed, and size of the apparatus.

Moreover, according to the embodiment, as it is evident from the trajectory of the acceleration command value Aref (T) of the intervals [2] to [5] in FIG. 5 and FIG. 6, in the deceleration no-print interval, after lowering the deceleration once down to zero, the deceleration is raised once again and the carriage 41 and the recording head 21 are decelerated rapidly. Consequently, according to the embodiment, at the beginning of the deceleration no-print interval, it is possible to transport the carriage 41 and the recording head 21 at a high velocity, and as a result, it is possible to decelerate the carriage 41 and the recording head 21 at a high speed from the deceleration-starting point Pd up to the turn-around point, and stop.

According to the embodiment, since the resumed constant-velocity interval (interval [3] shown in FIG. 5 and FIG. 6) is provided immediately before the re-deceleration interval, it is possible to re-decelerate the carriage 41 after the fluctuation (control error) in the velocity of the carriage 41 is suppressed in the resumed constant-velocity interval. Consequently, according to the embodiment, it is possible to stop the carriage 41 and the recording head 21 with high accuracy at the turn-around point Pe.

Moreover, in the embodiment, as shown in FIG. 4B, in a case, in which the deceleration-starting point Pd is positioned at the print-interval end point Pa or at a downstream side in the transporting direction of the carriage 41 than the print-interval end point Pa, the carriage 41 and the recording head 21 are controlled such that, from the deceleration-starting point Pd up to the turn-around point Pe, the carriage 41 and the recording head 21 decelerate according to the acceleration profile in the intervals [6], [7], and [8] shown in FIG. 7, in which the peak of the deceleration is |A|. Particularly, the carriage 41 and the recording head 21 are controlled such that, till the carriage 41 and the recording head 21 reach the deceleration-starting limit point Pf from the deceleration-starting point Pd, the deceleration of the carriage 41 is suspended, and from a point of time at which, the carriage 41 and the recording head 21 have reached the deceleration-starting limit point Pf, the carriage 41 and the recording head 21 decelerate at the acceleration peak |A| according to the acceleration profile in the intervals [7] and [8] shown in FIG. 7. Consequently, according to the present invention, even in a case, in which the deceleration-starting point Pd is at the print-interval end point Pa or at the downstream side in the transporting direction of the carriage 41 than the print-interval end point, it is possible to transport the carriage 41 and the recording head 21 at a high velocity from the deceleration-starting point Pd up to the turn-around point, and stop.

Incidentally, the present invention is not restricted to the embodiment described above, and it is possible to adopt various modified embodiments. For instance, the printer apparatus 1 which forms an image on a paper by transporting the recording head 21 in the main scanning direction every time the paper is transported in the secondary scanning direction, has been exemplified as the embodiment described above. However, it is also possible to apply the present invention to a printer apparatus which forms an image on a paper by making the recording head 21 carry out the operation of jetting ink droplets while reciprocating the recording head 21 several times in the main scanning direction, for the same area of the paper.

Moreover, in the embodiment described above, an arrangement has been made such that in the deceleration relaxation interval (interval [2] shown in FIG. 5 and FIG. 6), the deceleration is lowered down to zero. However, an arrangement may be made such that, the deceleration is lowered till the deceleration becomes negative. In other words, at the beginning of the deceleration no-print interval, the deceleration of the carriage 41 may be stopped once, and the carriage 41 may be shifted to a state of acceleration.

The carriage transporting mechanism 40 according to the embodiment corresponds to a head transporting mechanism which transports a recording head. Moreover, the print control section 20, the CR-motor control section 30, and the main control section 10 which realizes the control of transportation of the carriage 41 and the control of jetting ink droplets by the recording head 21 via the print control section 20 and the CR-motor control section 30 correspond to an example of a control unit which controls the head transporting mechanism and the recording head.

What is claimed is:

1. An image forming apparatus comprising:

a recording head configured to jet ink droplets onto a sheet;

a head transporting mechanism configured to transport the recording head along a main scanning direction by applying a driving force to the recording head on one end side of the recording head in a secondary scanning direction perpendicular to the main scanning direction; and a control unit configured to control the head transporting mechanism to reciprocate the recording head along a transporting path extending in the main scanning direction, and control the recording head to form an image on the sheet by jetting the ink droplets under a condition that the recording head passes over an image formation area that is an area in the transporting path for forming the image on the sheet, wherein under a condition that the control unit controls the head transporting mechanism to transport the recording head toward a turn-around point in the transporting path, the control unit is configured to control the head transporting mechanism to decelerate the recording head in accordance with a first acceleration profile from a deceleration-starting point at an upstream side of the turn-around point up to an end of the image formation area, and control the head transporting mechanism to decelerate in accordance with a second acceleration profile, which has a peak of deceleration higher than a peak of deceleration of the first acceleration profile, from the end of the image formation area up to the turn-around point, and wherein the peak of deceleration of the first acceleration profile is lower than a minimum value of deceleration that causes tilting of the recording head.

2. The image forming apparatus according to claim 1,wherein the second acceleration profile is an acceleration profile in which the deceleration starts lowering, turns to rising, reaches the peak, and starts lowering down to zero.

3. The image forming apparatus according to claim 2, wherein the second acceleration profile includes a constant-velocity interval in which the deceleration is zero between a time at which the deceleration starts lowering and a time at which the deceleration turns to rising.

4. The image forming apparatus according to claim 1, wherein the peak of deceleration of the second acceleration profile is a maximum deceleration that can be realized by controlling the head transporting mechanism.

5. The image forming apparatus of claim 4, wherein the maximum deceleration that can be realized by controlling the head transporting mechanism comprises a maximum deceleration based on load torque of the head transporting mechanism and a maximum value of current that can be applied to the head transporting mechanism to decelerate the recording head.

6. The image forming apparatus according to claim 1, wherein under the condition that the control unit controls the transporting mechanism to transport the recording head toward the turn-around point, the control unit transports the recording head at a constant velocity until the recording head reaches the deceleration-starting point, in a case that the deceleration-starting point is at the upstream side of the end of the image formation area, the control unit controls the transporting mechanism to decelerate the recording head in accordance with the first acceleration profile from the deceleration-starting point up to the end of the image formation area, and controls the transporting mechanism to decelerate the recording head in accordance with the second acceleration profile from the end of the image formation area up to the turn-around point, and in a case that the deceleration-starting point is at the end of the image formation area or at a downstream side of the end of the image formation area, the control unit controls the transporting mechanism to decelerate the recording head in accordance with a third acceleration profile that has a peak of deceleration same as the peak of deceleration in the second acceleration profile, from the deceleration-starting point up to the turn-around point.

7. The image forming apparatus of claim 1, wherein the peak of deceleration of the first acceleration profile is lower than a minimum value of deceleration that causes mistracking of the recording head.

8. The image forming apparatus of claim 1, wherein the head transporting mechanism comprises a pressing portion, and wherein the minimum value of deceleration that causes tilting of the recording head is calculated using a value of a spring bias applied by the pressing portion.

9. The image forming apparatus of claim 1, wherein the turn-around point is determined by a current print interval and a print interval of a subsequent line.

10. The image forming apparatus of claim 1, wherein the second acceleration profile comprises a first deceleration rate and a second deceleration rate, wherein the first deceleration rate is different than the second deceleration rate.

11. An image forming apparatus configured to form an image by jetting ink droplets onto a sheet, comprising:

a recording head configured to jet ink droplets;

a head transporting mechanism configured to transport the recording head along a main scanning direction by applying a driving force to the recording head on one end side of the recording head in a secondary scanning direction perpendicular to the main scanning direction; and a control unit configured to control the head transporting mechanism to reciprocate the recording head along a transporting path extending in the main scanning direction, and also control the recording head to form an image on the sheet by jetting the ink droplets under a condition that the recording head passes over an image formation area that is an area in the transporting path for forming the image on the sheet, wherein under a condition that the control unit controls the head transporting mechanism to transport the recording head toward a turn-around point in the transporting path, the control unit is configured to control the head transporting mechanism to decelerate the recording head from a deceleration-starting point at an upstream side of the turn-around point, and in a case that an end of the image formation area is positioned between the deceleration-staring point and the turn-around point, the control unit is configured to control the head transporting mechanism to make a peak of deceleration in an interval from the end of the image formation area up to the turn-around point higher than a peak of deceleration in an interval from the deceleration-starting point up to the end of the image formation area, and wherein the peak of deceleration in the interval from the deceleration-starting point up to the end of the image formation area is lower than a minimum value of deceleration that causes tilting of the recording head.

* * * * *